US008656546B2

(12) United States Patent
Wang

(10) Patent No.: US 8,656,546 B2
(45) Date of Patent: Feb. 25, 2014

(54) FOOT SCRUBBER WITH DETACHABLE BRISTLE SCRUBBER PAD

(76) Inventor: Jen Chuan Wang, Hacienda Heights, CA (US)

( * ) Notice: Subject to any disclaimer, the term of this patent is extended or adjusted under 35 U.S.C. 154(b) by 36 days.

(21) Appl. No.: 13/458,020

(22) Filed: Apr. 27, 2012

(65) Prior Publication Data

US 2013/0283552 A1 Oct. 31, 2013

(51) Int. Cl.
*A47K 7/02* (2006.01)

(52) U.S. Cl.
USPC ..... 15/104.92; 15/160; 4/606

(58) Field of Classification Search
USPC ..... 15/104.92, 105, 160; 4/606; 132/76.4
See application file for complete search history.

(56) References Cited

U.S. PATENT DOCUMENTS

| | | | | |
|---|---|---|---|---|
| 5,345,641 | A * | 9/1994 | Webster | 15/105 |
| 6,142,156 | A * | 11/2000 | Brunderman | 132/76.4 |
| 7,578,021 | B1 * | 8/2009 | Figueroa | 15/104.92 |
| 7,712,474 | B2 * | 5/2010 | Dixon | 132/76.4 |

* cited by examiner

*Primary Examiner* — Randall Chin

(57) ABSTRACT

This new foot scrubber is a combination of a foot dead skin and calluses remover and a bristled scrubber for cleaning purpose. The foot scrubber comprises a plastic bath mat with a plurality of suction cups and/or hook and loop fasteners on the bottom side to secure the mat from moving when it is used in a bathtub or shower. The top side of the mat can be divided into three areas: (1) the left and right areas being both flat and covered with abrasive materials, (2) the front part of the center area having a semi-spherical dome shaped extrusion covered with abrasive materials, and (3) the rear part of the center area having a detachable bristle scrubber pad, wherein the rear part of the center area comprises a plurality of female part locking devices for the use of engaging the male part locking devices on the bottom side of the detachable bristle scrubber pad.

3 Claims, 6 Drawing Sheets

FOOT SCRUBBER WITH DETACHABLE BRISTLE SCRUBBER PAD

CROSS REFERENCE TO RELATED APPLICATIONS

| | | |
|---|---|---|
| 4246914 | January 1981 | Keyser |
| 4532668 | August 1985 | Slonicki |
| 4849271 | July 1989 | Weihrauch |
| D326931 | June 1992 | Tomsick |
| 5163200 | November 1992 | Carlin |
| D345627 | March 1994 | Thariani |
| 5293660 | March 1994 | Park |
| 5444888 | August 1995 | Withey |
| D363378 | October 1995 | Fredricks |
| 5729858 | March 1998 | Riffel |
| 6253407 | July 2001 | Bjelkevig |
| D455867 | April 2002 | Pratt |
| 6405400 | June 2002 | McClain |
| 6662398 | December 2003 | Thomson |
| 6684444 | February 2004 | Wheeler, et al. |
| 6733595 | May 2004 | Grillo |
| 6740052 | May 2004 | Regner |
| D610696 | February 2010 | Makuch |

TECHNICAL FIELD

The present invention relates to a foot scrubber that removes a foot's dead skin and calluses and it also equips with a detachable bristle scrubber pad which cleans the bottom and toes area of the feet. More specifically, this invention pertains to a new and improved foot care apparatus wherein the same is arranged for not only removing dead skin but also cleaning and massaging of the feet of an individual and eventually for a pair of healthy feet.

BACKGROUND OF THE INVENTION

Foot is the most distant part of our body and our hands can't work on our foot without sitting down and bending over. Because it is hard of reaching, foot hygiene, includes cleaning, massaging and smoothing of the skin on sides and bottom of feet, although a small job, could be easily ignored by us in our everyday living. Besides, dead skin build ups on our feet is annoying, recurring and lasting for as long as our life time.

There are dry and wet methods of removing foot dead skin and calluses. The dry method of removing foot dead skin and calluses is currently the most adopted method and it is done in seated position. For those who have difficulty in sitting down or bending over, the dry method is not appropriate for them. There are many handheld abrasive scraping tools and metal shavers sold on the market. A user will have to sit down on a chair, bending over, holding his foot with one hand and scrape off the foot's hard dead skin and calluses with another. The abrasive tool gradually loses its function when the cavities among the abrasives are filled with skin debris. The user will have to repeatedly clean up the dead skin debris retained in the cavities during the entire removal process. After removal, the collection of the light weighted dead skin debris which might spread all over the working area is another unpleasant experience. When the abrasive tool does not work on hardened dead skin, the user will have to use a sharp metal shaver to remove the foot dead skin. Metal shaver is a little dangerous; the user may accidentally cut into the healthy foot skin underneath and cause bleeding. Generally speaking, dry method is a time consuming process and it can only be done once in a while. For people who are either busy or having difficulty in sitting down or bending over, the dry method simply is not a good choice for them. Our art suggests a wet method of dead skin removal which does not have these disadvantages.

The wet method does the removing with skin soaked in water. Skin becomes soft and easier to be removed when soaked well with soap water and the best way to have soaked feet is in a shower. Although, the handheld abrasive tools had been proven working fairly good on removing the feet's dry dead skin and calluses, but the inconvenience of applying it to our feet in the shower is yet to be improved. We all agree that using the handheld abrasive scraping tool, standing in a shower on one foot and bending over to remove the other foot's dead skin is unsafe. Thus, there is a need of a device which would allow the user to stand safely in a shower or bathtub to apply the abrasive tool on various areas of the foot without bending over. This would be beneficial to many busy people because they can do both the foot hygiene and shower at the same time. The debris of dead skin is washed away along with shower water which is another advantage. Some prior arts use a mat having a plurality of suction cups on its lower surface for holding the mat on a shower or bathtub floor and bristled scrubbing brushes on its upper surface. Those suction cups underneath the mat can securely hold the mat without being moved while a user brushes his feet on the bristles. Unfortunately, these bristled brush type foot scrubbers cannot effectively remove the foot's dried callused skin. Most of the time, the bristled brush can only work on cleaning the bottom of the feet but not able to remove the dead skin. If a person wanted to work on a callused area, the person would apply extra force on that area, when the foot is pressed hard against the bristled brush, the bristles just bend over and no smooth results. The bristled brush is very good for cleansing the bottom of the foot and the cavity areas between the toes. Nonetheless, such cleansing is important for people who have athlete's foot, diabetic foot ulcers, toe nail fungi and bad foot odors. Thus, the prior arts with bristles have presented solution for cleaning the feet but not adequately solved the problem of removing dead skin and calluses. While the prior arts striving for the removing of dead skin and cleaning of the feet with two different devices, we add a detachable bristle foot scrubber pad onto the base mat by attaching a few male part locking devices on the bottom of the detachable bristle scrubber pad to the corresponding female part locking devices on the top side of the base mat. Vice versa, the bristle scrubber pad can be detached by pulling the locking devices off the base mat. Since our art have both, the abrasives and the bristles, on the same upper surface area of the foot scrubber, it not only can effectively remove dead skin but also clean our foot.

SUMMARY OF THE INVENTION

In view of the foregoing disadvantages inherent in the known type of foot scrubbing devices presented in the prior arts, the present invention provides a new foot scrubbing device which not only effectively removes foot's dead skin and calluses but also cleans the bottom of foot and toes area in a shower or bathtub in a hand free manner.

It is therefore an object of the present invention to provide a new and improved foot scrubber which has all the advantages of the prior arts of foot scrubbing apparatus and none the disadvantages.

It is another object of the present invention to provide a novel foot scrubber which may abrasively remove dead skin and calluses and bristlely clean foot bottom in a shower.

It is a further object of the present invention to provide a novel foot scrubber which may safely remove dead skin and calluses and clean foot bottom in a shower or bathtub without bending over in a hands free manner.

It is a further object of the present invention to provide a novel foot scrubber which may safely remove dead skin and calluses, clean foot bottom and do not take a lot of time for the user in a shower.

There is yet another object of the present invention to provide a foot scrubber which aids and assists the alleviation of foot discomfort due to dead skin build up, calluses, foot hygiene and eventually to a healthy foot.

This new foot scrubber is a combination of a foot dead skin and calluses remover and a detachable foot cleaning bristle pad. The novel foot scrubber comprises a plastic bath mat of our design with a plurality of suction cups and/or hook and loop fasteners on the bottom side to secure the mat without being moved when use in a bathtub or shower. The top side of the mat is divided into three areas as left, right and center areas. The left and right areas are both flat and been treated with abrasive materials. A semi-spherical dome shaped extrusion covered with abrasives is located at the front part of the center area. A plurality of female locking devices is located at the rear part of the middle area for the accommodation of those male locking devices on the bottom side of a detachable bristle scrubber pad.

DETAILED DESCRIPTION OF THE INVENTION

Figure 1:
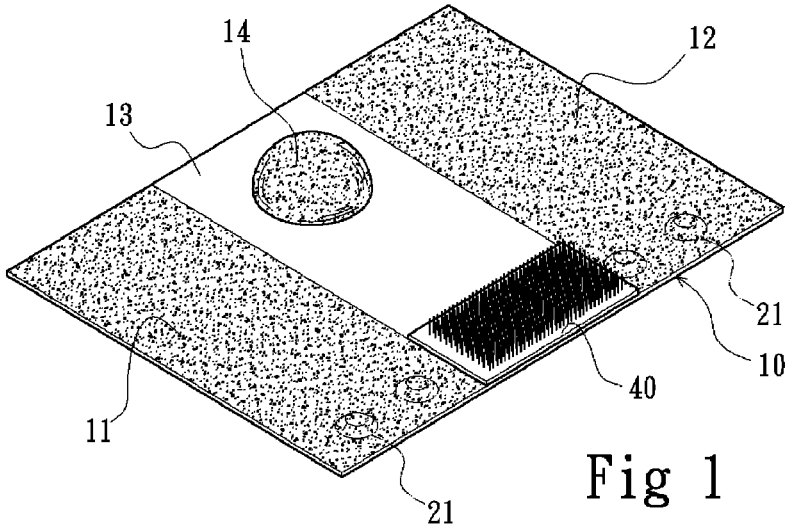
FIG. 1 is a perspective view of a foot scrubber with the attachable bristle scrubber pad in accordance with the present invention.
Figure 1A:
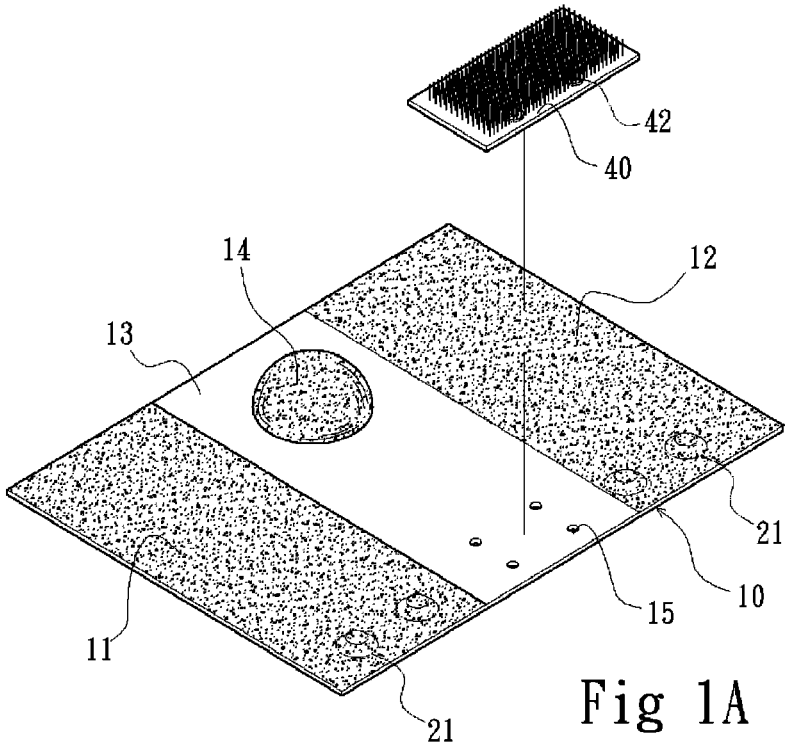
FIG. 1A is an explosive view of a foot scrubber with the attachable bristle scrubber pad in accordance with the present invention.

Referring to FIGS. 1 & 1A, the top surface of the foot scrubber 10 is divided into three areas, the left 11 and the right area 12 are flat and covered with abrasives which can be used to remove the foot bottom's dead skin and calluses by scrubbing the foot bottom, in back and forth or left and right direction, against the abrasives. At the front part of the center area 13, there is a semi-spherical dome shaped extrusion 14 which is also covered with abrasives. This semi-spherical dome shaped extrusion 14 covered with abrasives can remove the dead skin of the arch, inside, outside and the back side areas of both feet. At the rear part of the center area 13, there is a plurality of female part locking devices 15 which are used to adopt the male part locking devices 42 on the bottom of a detachable bristle scrubber pad 40. There is a plurality of suction cups 21 on the bottom surface of the foot scrubber.

Figure 2:
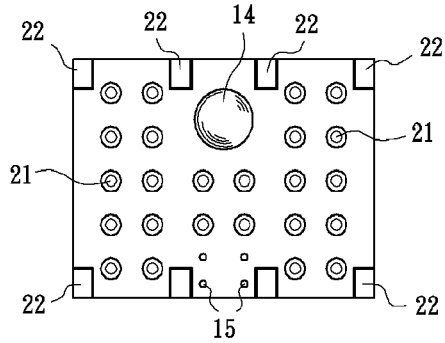
FIG. 2 is a bottom view of a foot scrubber with suction cups in accordance with the present invention.
Figure 2A:
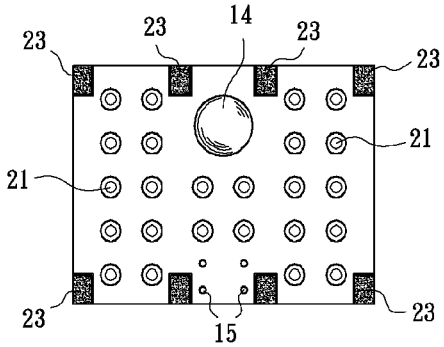
FIG. 2A is a bottom view of a foot scrubber with suction cups and hook fasteners of a preferred embodiment in accordance with the present invention.
Figure 2B:
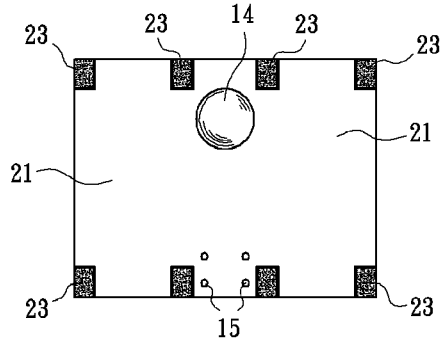
FIG. 2B is a bottom view of a foot scrubber with only hook fasteners of a preferred embodiment in accordance with the present invention.

Referring to FIG. 2, 2A and 2B, there is a plurality of suction cups 21 on the bottom side of the scrubber 10. As a whole bath mat piece, the suction cups 21 are molded together with the scrubber 10. These suction cups 21 work perfectly well on smooth and glossy surfaces providing enough suction force to keep the foot scrubber from moving during use. As the newer bathtub or shower often comes with uneven or not glossy floor surface, suction cups 21 alone do not work well on these uneven floor surfaces. A plurality of loop fasteners and hook fasteners are used to provide enough holding force that we need. A plurality of hook fasteners 23 is securely affixed to the bottom side of the foot scrubber at its designated locations 22 and loop fastener 24 are attached to their corresponding hook fasteners 23. Now, a user needs to determine the location of the loop fasteners 24 on the shower or tub floor first. The best location to place the foot scrubber on the bathtub or shower floor is where the user stand comfortably for the shower. After finding the right location for the foot scrubber, the user cleans the foot scrubber covered area on the bathtub or shower floor thoroughly with scrubbing alcohol. And after the area is fully dried, the user affixes the loop fasteners 24 at the proper corresponding locations on the cleaned shower floor. Then, the foot scrubber 10 is placed onto the shower floor by attaching the corresponding hook fasteners 23 on the bottom side of the foot scrubber 10 to those loop fasteners 24.

Figure 3:
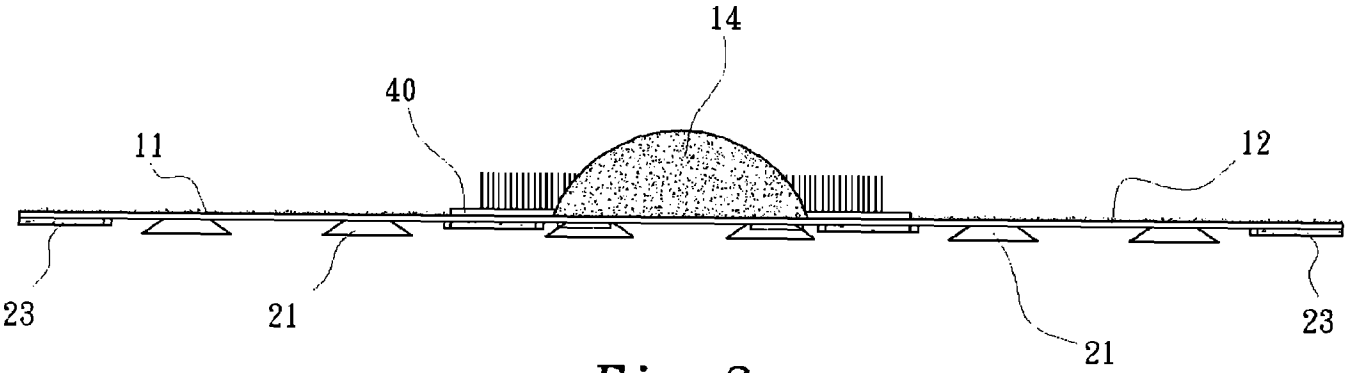
FIG. 3 is a side cross sectional view of a foot scrubber with suction cups and hook fasteners of a preferred embodiment in accordance with the present invention.
Figure 3A:
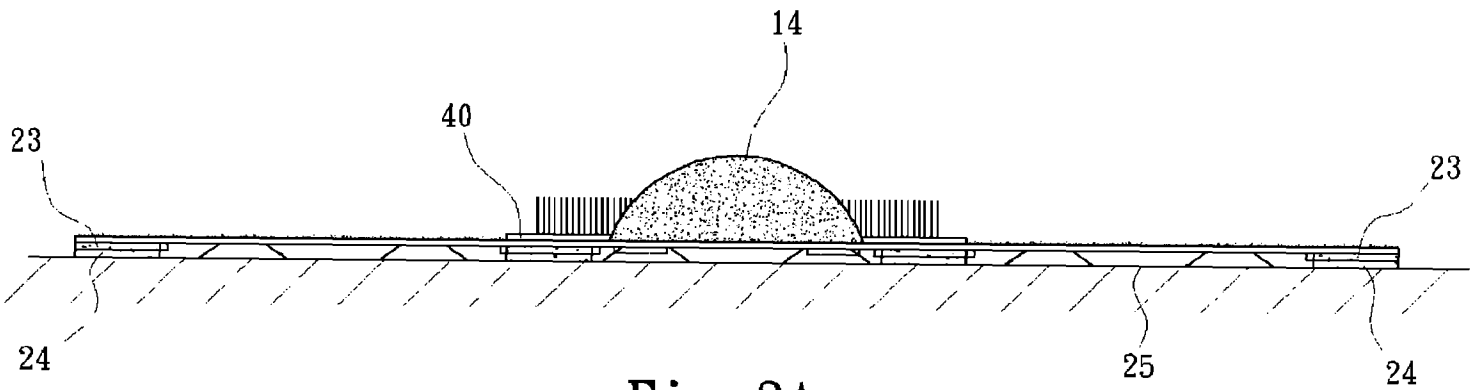
FIG. 3A is a side cross sectional view of a foot scrubber with suction cups and hook fasteners, the hook fasteners are attached to their corresponding loop fasteners which is affixed onto a tub floor in accordance with the present invention.

FIG. 3 shows the side sectional view of the foot scrubber 10 with area 11 and 12 at the same height of area 13. Both areas 11 and 12 may also be recessed to area 13 with a recessed height of 0.5 mm to 2 mm. The exact depth of recess is equal to the thickness of the abrasive layer. There are a plurality of suction cups 21 and hook fasteners 23 on the bottom side of the scrubber. FIG. 3A shows the side sectional view of the foot scrubber with suction cups and hook fasteners 23 attached to their corresponding loop fasteners 24 which are affixed on the bathtub or shower floor 25.

Figure 4:
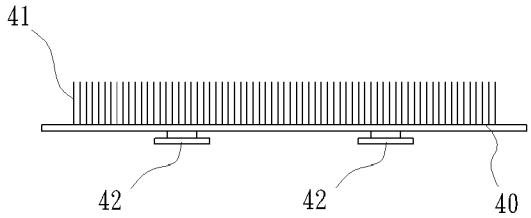
FIG. 4 is a side cross sectional view of a detachable bristle pad of a preferred embodiment in accordance with the present invention.
Figure 4A:
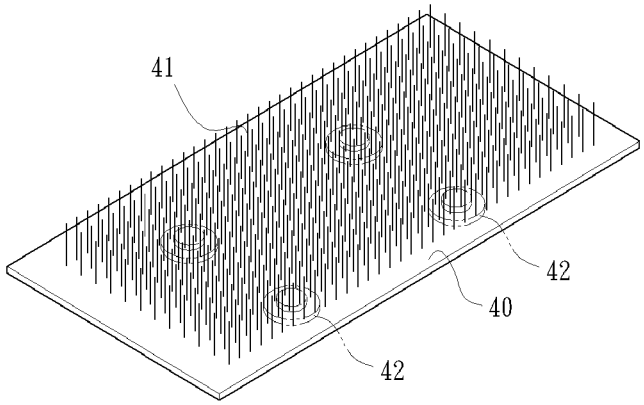
FIG. 4A is a perspective view of the detachable bristle foot scrubber pad of a preferred embodiment in accordance with the present invention.
Figure 5:
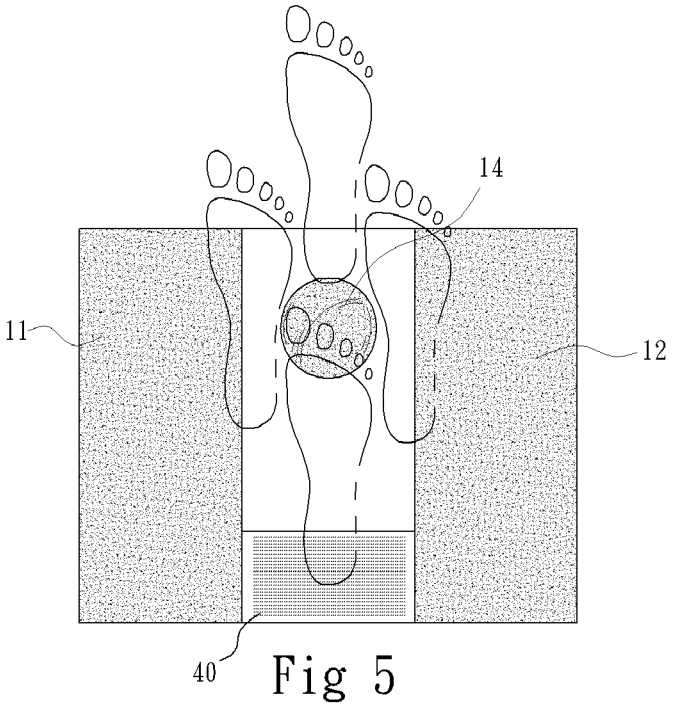
FIG. 5 is a top view of the different ways a left foot can be rubbed on the semi-spherical dome shaped extrusion of a preferred embodiment in accordance with the present invention.
Figure 5A:
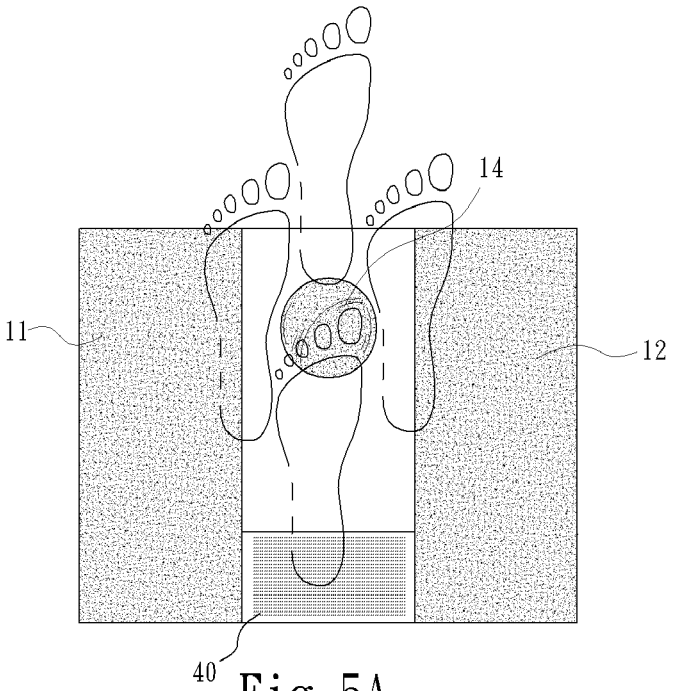
FIG. 5A is a top view of the different ways a right foot can be rubbed on the semi-spherical dome shaped extrusion of a preferred embodiment in accordance with the present invention.

FIG. 4 is showing the side sectional view of the detachable bristle foot scrubber pad 40, the upper surface of the bristle foot scrubber pad is full of plastic bristles 41 and the bottom side has a plurality of male part locking devices 42 that work with the female locking devices 15 on the foot scrubber. In order to attach the bristle foot scrubber pad 40 to the foot scrubber 10, a user just carefully engages a plurality of male part locking devices 42 on the bottom side of the bristle foot scrubber pad 40 into the female part locking devices 15. FIG. 4A is a perspective view of the detachable bristle foot scrubber pad 40. Move the foot bottom against the bristles 41 cleans the bottom of foot and cavities at the toes area. There is a plurality of male part locking devices 42 on the bottom side of the bristle pad. FIG. 5 shows the locations where the left foot scraped on the semi-spherical dome shaped extrusion 14 and FIG. 5A shows the locations where the right foot scraped on the semi-spherical dome shaped extrusion 14.

Figure 6:
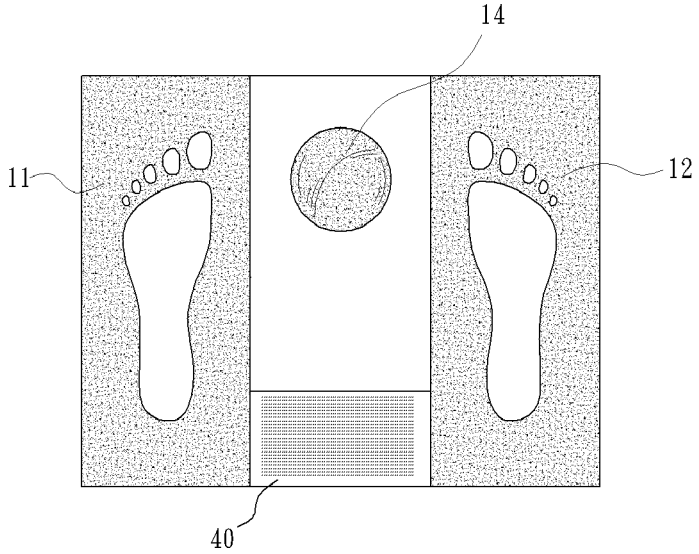
FIG. 6 is a top view of the locations of a pair of foot rest on a foot scrubber with the bristle foot scrubber pad of a preferred embodiment in accordance with the present invention.

FIG. 6 is showing the locations of left and right foot resting on area 11 and 12 of the foot scrubber 10 during shower, the foot scrubber could be used as an anti-slip bath mat as well.

Prior to using the scrubber, where to put the foot scrubber on the bathtub or shower floor has to be determined first. The best location for that is the standing place where the shower falls on the user's head or where the user stands comfortably to take a shower. If the bathtub or shower floor is flat and glossy, simply press the suction cups down to the floor and step on the scrubber comfortably. If the bathtub or shower floor is uneven or not glossy, the use of hook and loop fasteners is recommended. If hook and loop fasteners are to be used, carefully clean the floor area, where we are going to affix the loop fasteners on the bathtub or shower floor, with rubbing alcohol first. After the floor is cleaned and dried, firmly affix the loop fasteners to the bathtub floor. Now, the hook and loop fasteners' interlocking force will hold the foot scrubber to the bathtub floor well. Leave those loop fasteners on the floor after use. They are small and flat and will not affect our normal use of the bathtub or shower.

The bristle pad 40 is detachable, so you can choose to put it on or take it off before use. When the scrubber 10 is in place, put your left foot comfortably on the left area 11 and the right foot on the right area 12 of the foot scrubber 10. The scrubber can be used as an anti-slip bath mat. The best time to scrub the soaked feet is when you are ready to do the final wash. At this time, the foot skin is soaked with soap water and the top layer of the skin is easy to be removed. Dead skin or calluses on the bottom of the foot could be removed by the forward and backward movements of the feet on the abrasive areas, 11 and 12, of the foot scrubber 10. Scrape hard on the foot scrubber if necessary. One foot at a time, you can put your hands on the wall to help your body balanced safely. The left side of the semi-spherical dome shaped extrusion scrubs the arch and inside side of the left foot and the outside side of the right foot. The right side of the semi-spherical dome shaped extrusion scrubs the arch and inside side of the right foot and the outside side of the left foot. The front side of the semi-spherical dome shaped extrusion scrubs the back side of both feet. The top and the rear sides of the semi-spherical dome shaped extrusion scrub the toes and immediate areas around the toes of both feet. The bristle scrubbing pad 40 which is used to clean the bottom of the feet and the toes area can either be attached or detached before use. The entire scrubbing could be done in about one to two minutes. Take the foot scrubber 10 out or leave it on the floor after use is up to the user's choice. However, to keep the foot scrubber dry and clean is recommended.

The present invention has reached the objectives of removing foot's dead skin or calluses, cleaning the foot bottom and toes area, in a hands free manner, without bending over, do not waste much of the time, aids and assists the alleviation of foot discomfort due to skin build up and calluses, foot hygiene, massaging and results in a healthy foot.

The invention is not limited to the above embodiment but various modifications thereof may be made. Further changes in form and detail may be considered without departing from the scope of this invention.

The invention claimed is:

1. A foot scrubber bath mat having a base with a plurality of suction cups directly anchored on the bottom side of said base, wherein the opposite side of said bottom side is a top surface which can be divided into three areas, left, center and right, with different features including: (1) said left and right areas being flat and covered with abrasives, (2) said center area being divided into two parts, front and rear, wherein (3) the front part of the center area having a semi-spherical dome extrusion covered with abrasives, and (4) the rear part of the center area having a plurality of female part locking devices for the use of engaging male part locking devices on the bottom side of a detachable bristle scrubber pad.

2. A foot scrubber bath mat having a base with a plurality of suction cups directly anchored and hooks fasteners affixed on the bottom side of said base, wherein the opposite side of said bottom side is a top surface which can be divided into three areas, left, center and right, with different features including: (1) said left and right areas being flat and covered with abrasives, (2) said center area being divided into two parts, front and rear, wherein (3) the front part of the center area having a semi-spherical dome extrusion covered with abrasives, and (4) the rear part of the center area having a plurality of female part locking devices for the use of engaging male part locking devices on the bottom side of a detachable bristle scrubber pad.

3. A foot scrubber bath mat having a base with a plurality of hooks fasteners affixed on the bottom side of said base, wherein the opposite side of said bottom side is a top surface which can be divided into three areas, left, center and right, with different features including: (1) said left and right areas being flat and covered with abrasives, (2) said center area being divided into two parts, front and rear, wherein (3) the front part of the center area having a semi-spherical dome extrusion covered with abrasives, and (4) the rear part of the center area having a plurality of female part locking devices for the use of engaging male part locking devices on the bottom side of a detachable bristle scrubber pad.

* * * * *